US008808034B2

(12) United States Patent
Wu et al.

(10) Patent No.: US 8,808,034 B2
(45) Date of Patent: Aug. 19, 2014

(54) CABLE ASSEMBLY WITH NEW ARRANGEMENT OF TERMINALS

(71) Applicant: Hon Hai Precision Industry Co., Ltd., New Taipei (TW)

(72) Inventors: Jerry Wu, Irvine, CA (US); Jun Chen, Kunshan (CN)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 79 days.

(21) Appl. No.: 13/670,810

(22) Filed: Nov. 7, 2012

(65) Prior Publication Data

US 2013/0115823 A1 May 9, 2013

(30) Foreign Application Priority Data

Nov. 7, 2011 (CN) ..... 2011 1 0347620

(51) Int. Cl.
*H01R 24/00* (2011.01)

(52) U.S. Cl.
USPC ..... 439/660

(58) Field of Classification Search
USPC ..... 439/676, 626, 701, 660, 493
See application file for complete search history.

(56) References Cited

U.S. PATENT DOCUMENTS

| | | | | |
|---|---|---|---|---|
| 6,652,296 | B2 * | 11/2003 | Kuroda et al. | 439/95 |
| 6,863,549 | B2 * | 3/2005 | Brunker et al. | 439/108 |
| 6,935,870 | B2 * | 8/2005 | Kato et al. | 439/108 |
| 7,390,220 | B1 * | 6/2008 | Wu | 439/607.06 |
| 7,422,488 | B1 * | 9/2008 | Wu | 439/676 |
| 7,534,141 | B1 * | 5/2009 | Wu | 439/607.01 |
| 7,537,488 | B2 * | 5/2009 | Iwakawa | 439/660 |
| 7,621,788 | B1 * | 11/2009 | Feng | 439/885 |
| 7,758,379 | B2 * | 7/2010 | Chen | 439/607.11 |
| 7,972,151 | B2 * | 7/2011 | He et al. | 439/108 |
| 2010/0210124 | A1 * | 8/2010 | Li | 439/108 |

* cited by examiner

*Primary Examiner* — Neil Abrams
*Assistant Examiner* — Phuongchi T Nguyen
(74) *Attorney, Agent, or Firm* — Ming Chieh Chang; Wei Te Chung

(57) ABSTRACT

A cable assembly comprises: a housing defining a receiving space; a metallic shell surrounding the housing; and a number of terminals arranged into two rows and received in the housing, each terminal defining a front mating portion and a rear terminating portion and a cable electrically connected with the plurality of terminals. The terminals are divided into several terminal groups, each terminal group comprises a pair of signal terminals and a grounding terminal located on different rows, two terminating portions of the pair of signal terminals and a terminating portions of the grounding terminal are arranged into right-angled triangular configuration in a vertical plane.

13 Claims, 10 Drawing Sheets

CABLE ASSEMBLY WITH NEW ARRANGEMENT OF TERMINALS

BACKGROUND OF THE INVENTION

1. Field of the Invention

The present invention generally relates to a cable assembly, and more particularly to a cable assembly for transmitting high-speed signal.

2. Description of Related Art

Usually, a personal computer (PC) or consumer electronics (CE) product has a display for displaying video, and a cable assembly is needed to connect an interface of the display and a control device. A display port connector may be an ideal input/output (I/O) port adapted for both PC and CE products. However, cross talk may occur at interface section of the display port connector, which in turn may influence the quality of signals.

For example, U.S. Pat. No. 7,390,220 disclose a cable assembly comprising an insulated housing defining a receiving space, a plurality of terminals arranged into an upper and a lower terminal rows and received in the insulated housing, a metallic shell surrounding the insulated housing, a metal plate disposed between the upper terminal row and the lower terminal row, and a cable including a number of wires electrically connecting to the terminals and the metal plate. The terminals comprise a plurality of signal terminals and grounding terminals. In order to improve the high frequency performance of the cable assembly, the two mating sections of two adjacent signal terminals of the upper (or lower) terminal row and the mating section of a ground terminal of the lower (or upper) terminal row are structured in an isosceles triangle. And, the two tail sections of two adjacent signal terminals of the upper or lower terminal row and a tail section of a ground terminal of lower or upper terminal row are structured in an isosceles triangle structure. Obviously, a width of tail sections between two lateral terminals is become large and two lateral terminals are located adjacent to inner side of the metallic shell. In this design, for either row of terminals, there exists a laterally outermost terminal tail section which comes nearer to the metallic shell to such an extent making cable wire soldering thereto difficult or even resulting in short-circuiting of it with an immediate adjacent terminal tail section. In addition, the terminal tail sections arrangement in such design does not work well with molding process.

An improved cable assembly having a different arrangement of terminals is desired.

SUMMARY OF THE INVENTION

Accordingly, an object of the present invention is to provide an cable assembly to improve an arrangement of the terminals In order to achieve the object set forth, a cable assembly in accordance with the present invention comprises a housing defining a receiving space; a metallic shell surrounding the housing; a plurality of terminals arranged into two rows, and received in the housing, each terminal defining a front mating portion and a rear terminating portion; and a cable electrically connected with the plurality of terminals. The plurality of terminals are divided into several terminal groups, each terminal group comprises a pair of signal terminals and a grounding terminal located on different rows, two terminating portions of the pair of signal terminals and a terminating portions of the grounding terminal are arranged into right-angled triangular configuration in a vertical plane.

Other objects, advantages and novel features of the invention will become more apparent from the following detailed description when taken in conjunction with the accompanying drawings.

DETAILED DESCRIPTION OF THE INVENTION

Figure 1:
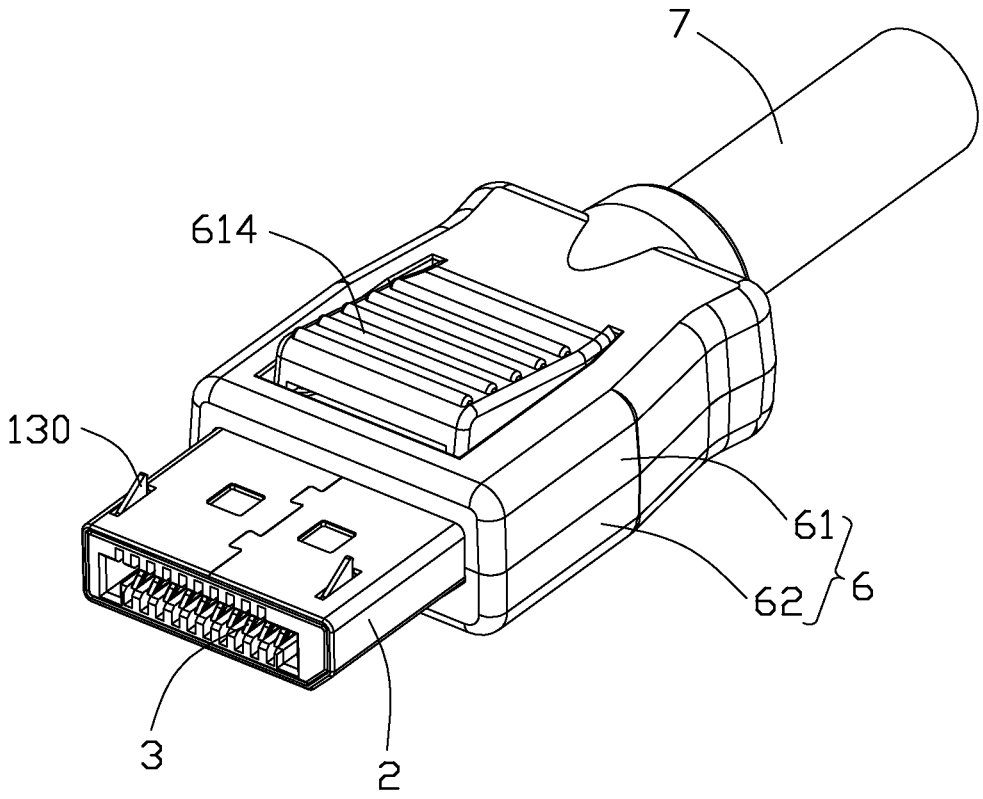
FIG. 1 is an assembled, perspective view of a cable assembly in accordance with the present invention.

Reference will now be made in detail to the preferred embodiment of the present invention.

Referring to FIGS. 1-8, a cable assembly 100 in accordance with the present invention comprises an insulated housing 2, a plurality of terminals 3 arranged on a spacer 4 and then together received in the insulated housing 2, a metallic plate 5 embedded in the spacer 4, a metallic shell 1 enclosing the insulated housing 2, a cable 7 electrically connected to the terminals 3, and a cover 6 partially shielded the metallic shell 1 and the cable 7.

Referring to FIGS. 2-3 and 5-6, the insulated housing 2 comprises a top wall 23, an opposite bottom wall 21, and a pair of side walls 22, 24 connecting with the top and the bottom walls 23, 21. The insulated housing 2 defines a receiving space 20 formed by the top wall 23, the bottom wall 21 and two side walls 22, 24. The top wall 21 and the bottom wall 22 respectively defines a plurality of terminal passages 25 formed on an inner surface thereof. The top wall 23 and the bottom wall 21 respectively defines two spaced protruding portions 210 formed thereon. Each of protruding portions 210 defines a locking member 211 formed thereon. The top wall 23 defines two slits 230 formed on a top surface thereof. Each of side wall 22, 24 defines a defines a protrusive portion 231 formed on a rear end thereof.

Figure 2:
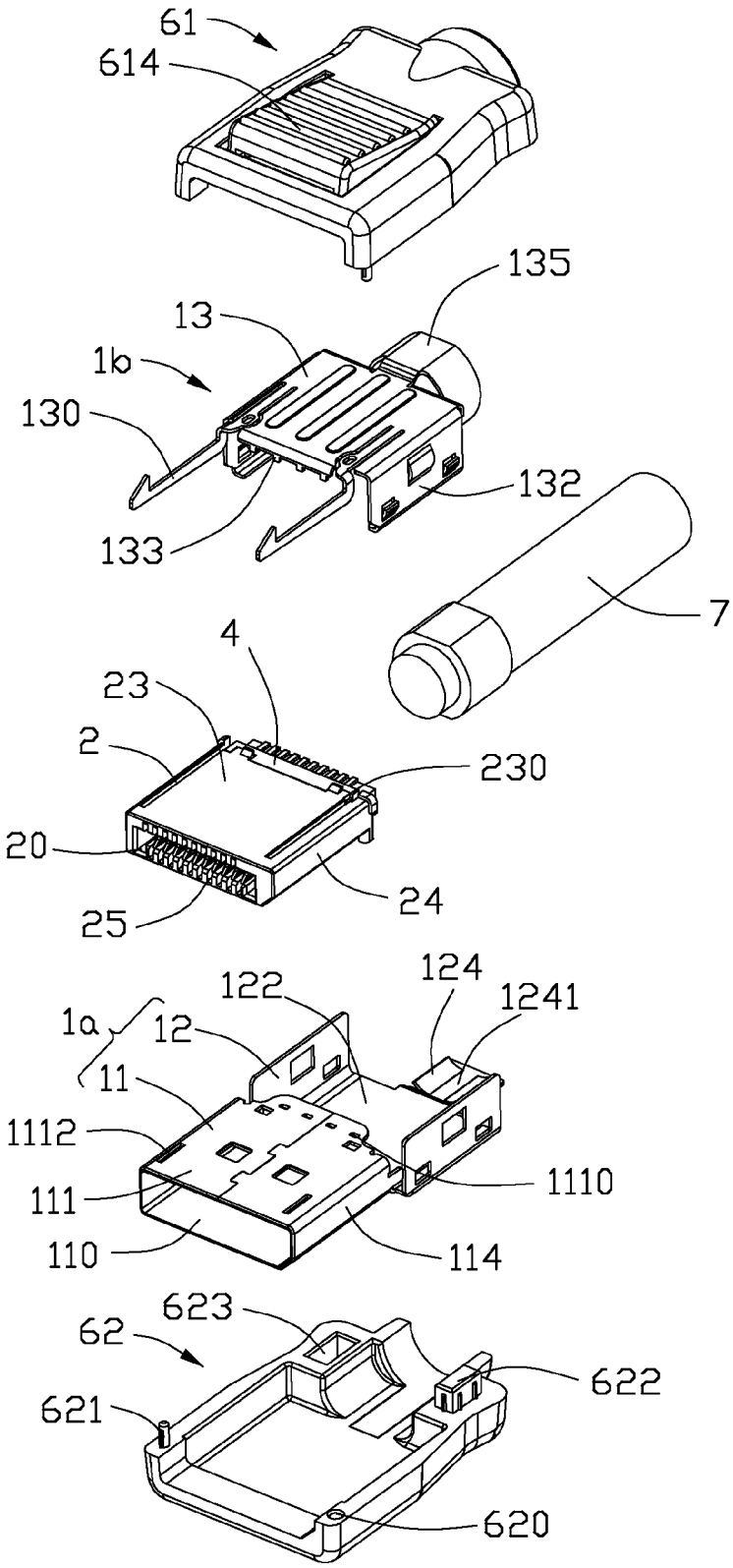
FIG. 2 is an exploded, perspective view of FIG. 1.
Figure 3:
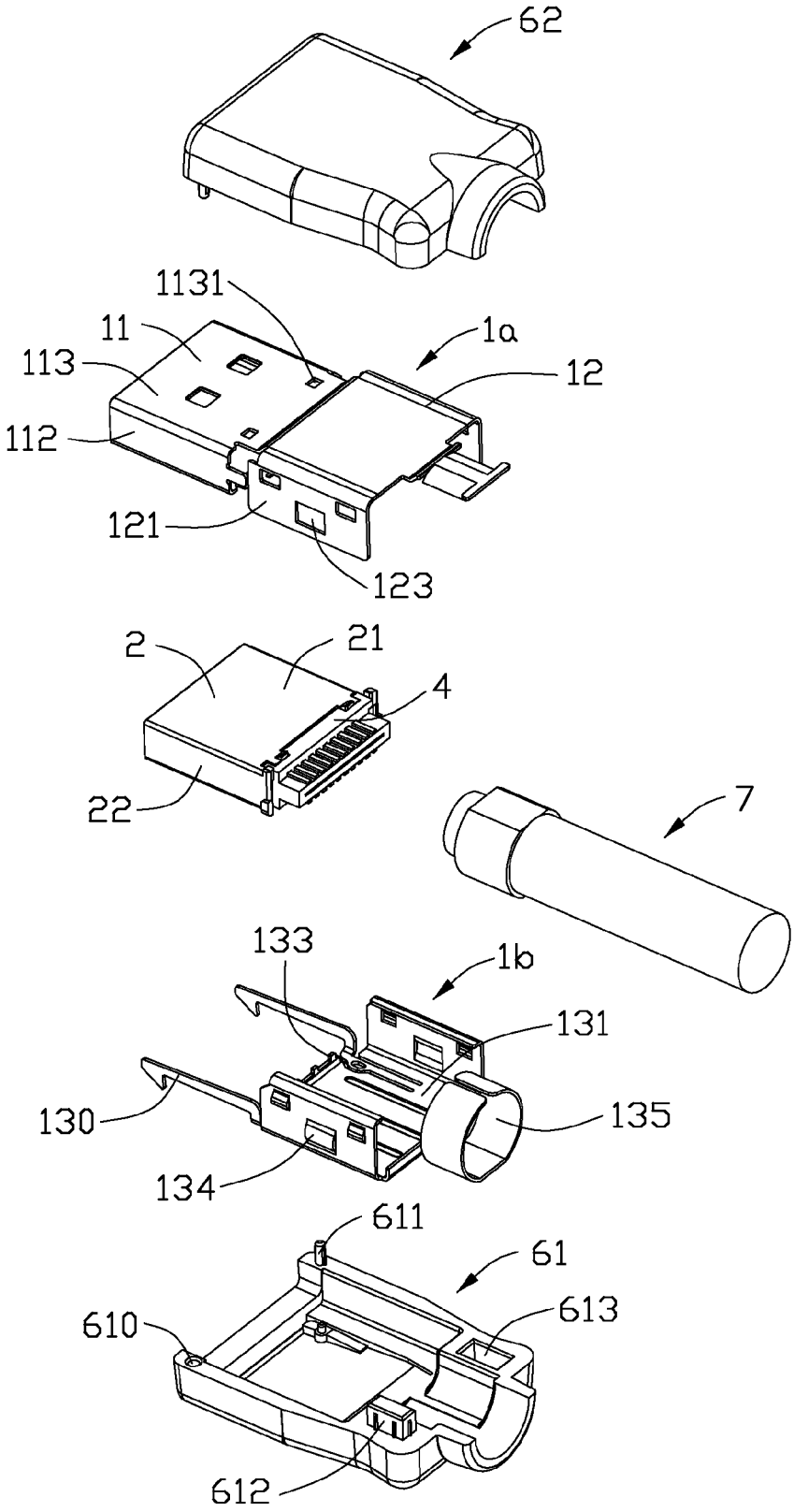
FIG. 3 is similar to FIG. 2, but viewed from another aspect.

Referring to FIGS. 1-3, the metallic shell 1 comprises a first shield portion 1*a* and a second shield portion 1*b* assembled with each other. The first shield portion 1*a* comprises a front frame portion 11 defining a bottom side 113, an opposite top side 111, and a pair of lateral sides 112, 114 connecting the top and the bottom sides 111, 113 to form a receiving room 110 for receiving the insulated housing 2. The top side 111 defines four holes 1110 formed on a rear section thereof. And, the top and bottom sides 111, 113 respectively defines a pair of apertures 1131 formed thereof. The top side 111 further defines two slots 1112 formed thereon. The first shield portion 1*a* further comprises a rear U-shaped portion 12 rearward extending from a lower side 113 of the front frame portion 11. The rear U-shaped portion 12 also comprises a bottom section 122 and a pair of side sections 121 extending upwardly from two sides of the bottom section 122 and a supporting section 124 extending rearward from a rear edge of bottom section 122. The supporting section 124 defines a flat section 1241 formed on a middle section formed thereof. Each side section 121 of the rear U-shaped portion 12 defines three locking holes 123. The second shield portion 1*b* comprises a n-shaped portion 13 and a cable holder 135 extending rearwardly from a rear edge of the n-shaped portion 13. The n-shaped second portion 13 also comprises a top section 131, a pair of side sections 132 extending downwardly from two sides of the top section 131, and a pair of locking arms 130 extending forwardly from a front edge of the n-shaped portion 13. Each side section 132 defines three locking tabs 134 cooperated with three corresponding locking holes 123 of the side section 121 of the rear U-shaped portion 12. The top section 131 further defines four tabs 133 cooperated with four holes 1110.

Figure 4:
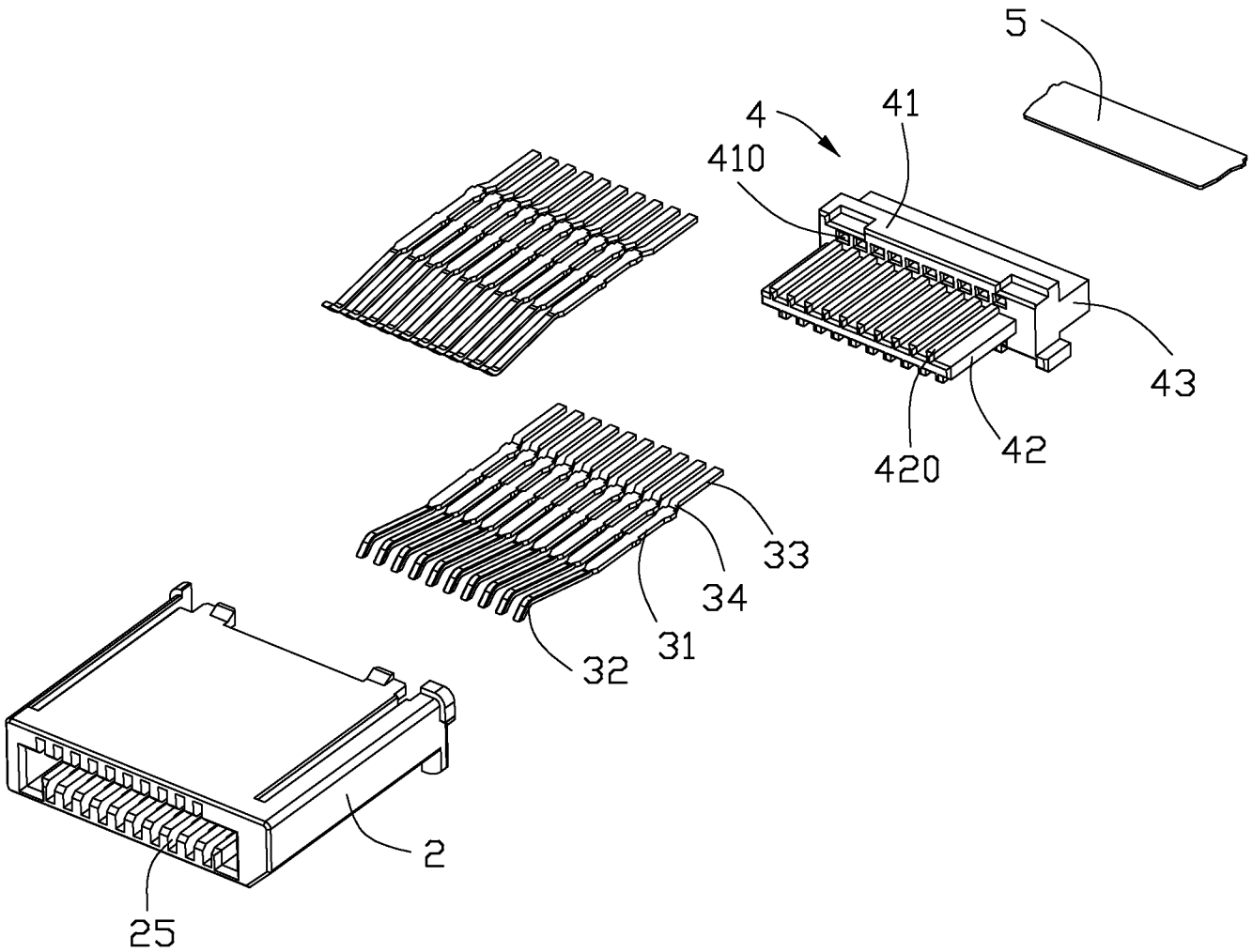
FIG. 4 is an exploded view of an insulated housing, a number of terminals, a spacer, and a metal plate of the cable assembly.
Figure 5:
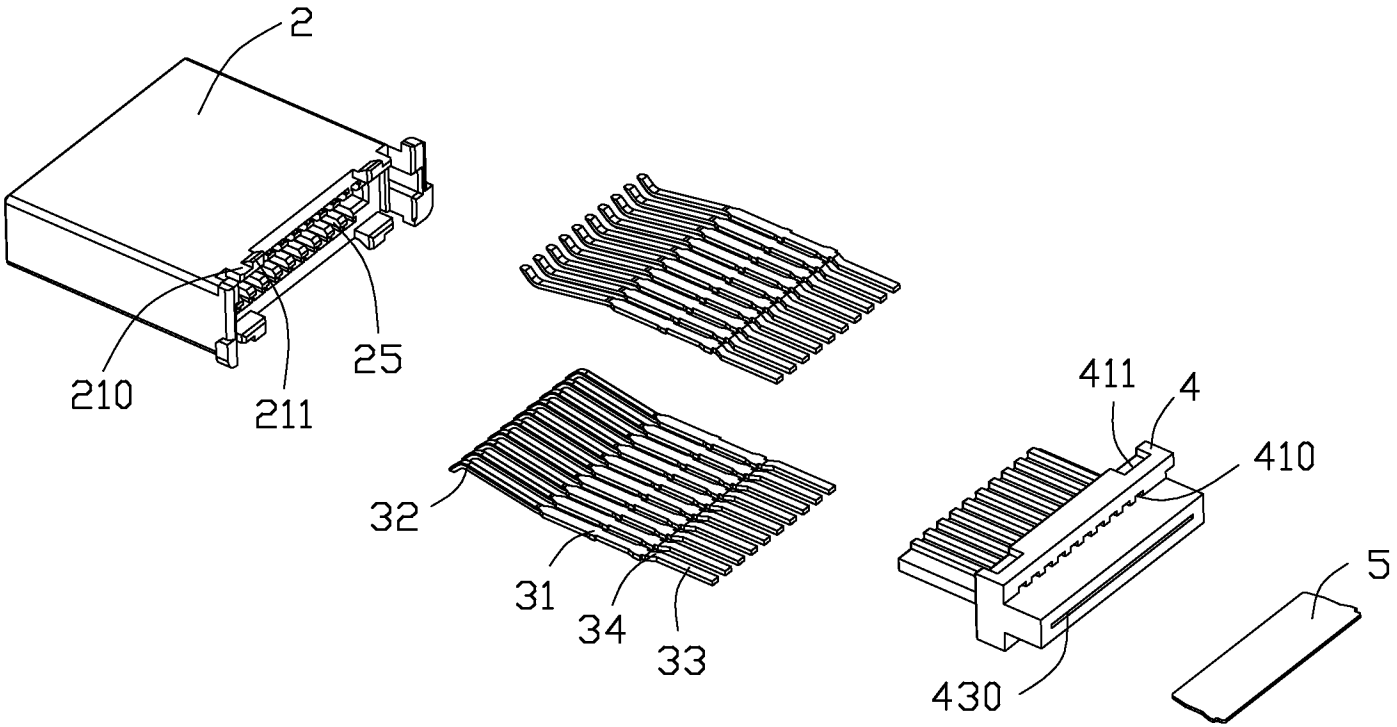
FIG. 5 is similar to FIG. 4, but viewed from another aspect.
Figure 6:
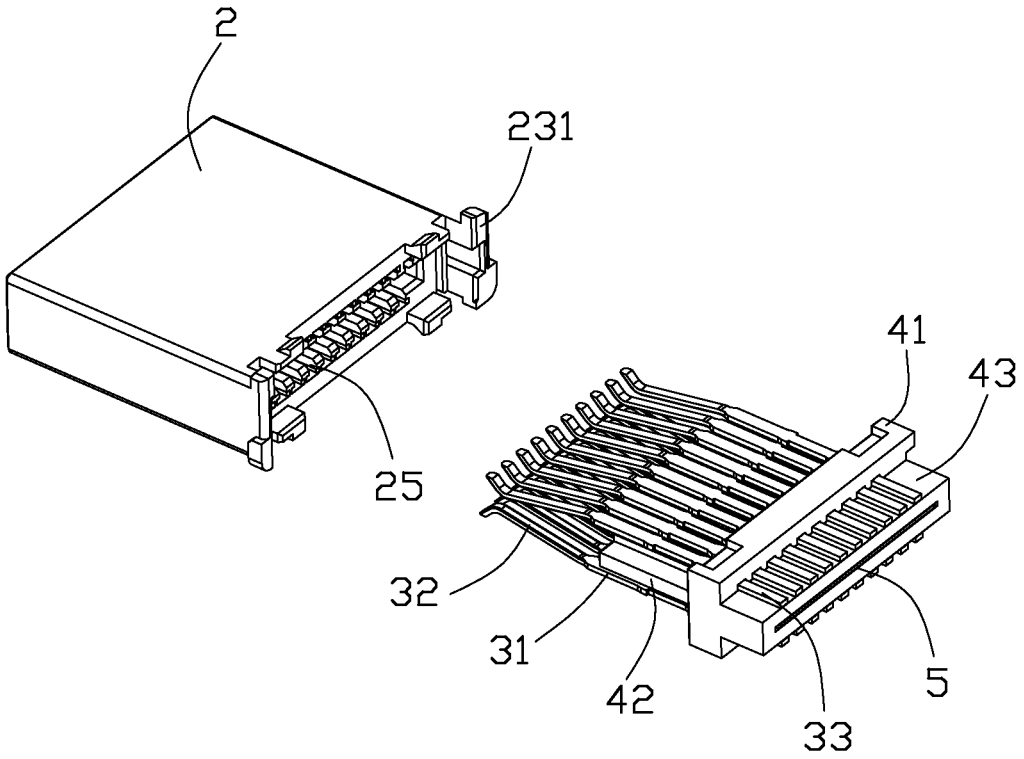
FIG. 6 is a partially assembled, perspective view of FIG. 5.

Referring to FIGS. 4-6, a plurality of terminals 3 are divided into an upper and lower rows and accommodated in the insulated housing 2. Each terminal 3 with identical configuration comprises a flat body portion 31, a curved mating portion 32 extending forward from a front end of the body portion 31, and an terminating portion 33 extending rearwardly from a rear end of the body portion 31. The terminating portion 33 and the body portion 31 are on the same level (horizontal plane). And the terminating portion 33 is deflected from the body portion 31 along a transversal direction perpendicular to a mating direction of the cable assembly 100. The terminal 3 further comprises a bending portion 34 connected with the body portion 31 and the terminating portion 33. The bending portions 34 of an upper row of terminals 3 extends along a left-to-right direction. And, the bending portions 34 of the lower row of terminals 3 extends along a right-to-left direction. Thus, the terminating portions 33 of the upper row of terminals 3 are respectively in alignment with the terminating portions 33 of the lower row of terminals 3 along a vertical direction.

Figure 7:
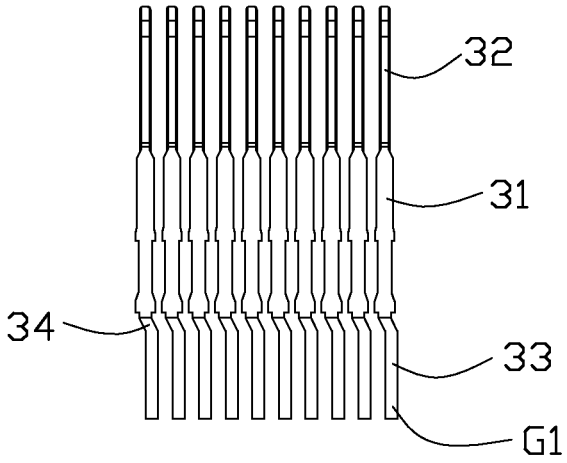
FIG. 7 is a planform view of a lower row of the terminals of the cable assembly as shown in FIG. 4.
Figure 8:
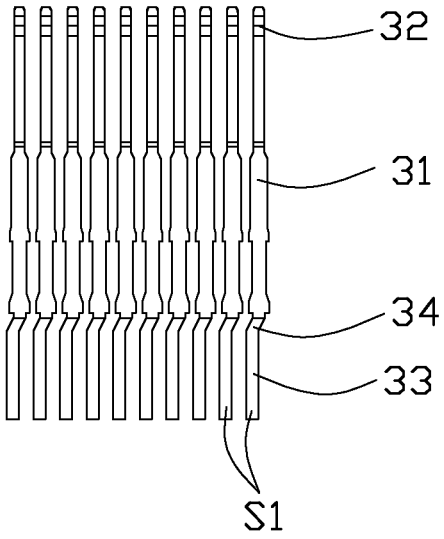
FIG. 8 is a planform view of an upper row of the terminals of cable assembly as shown in FIG. 4.
Figure 9:
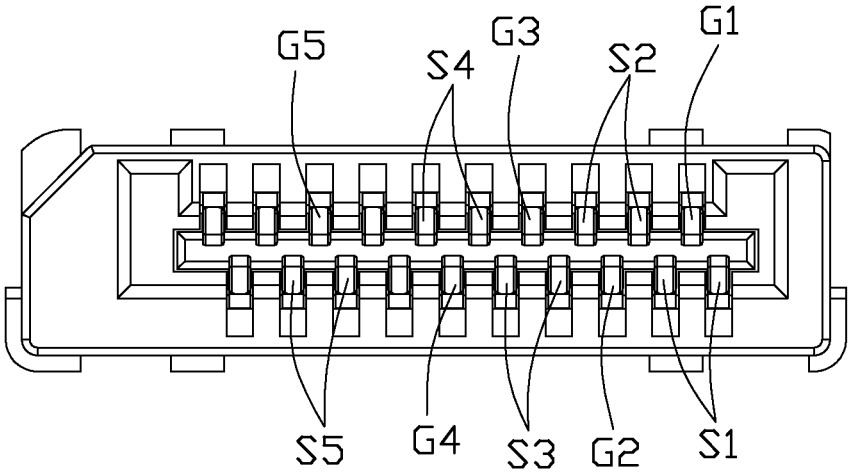
FIG. 9 is a front view of the terminals and the insulated housing assembled with each other.
Figure 10:
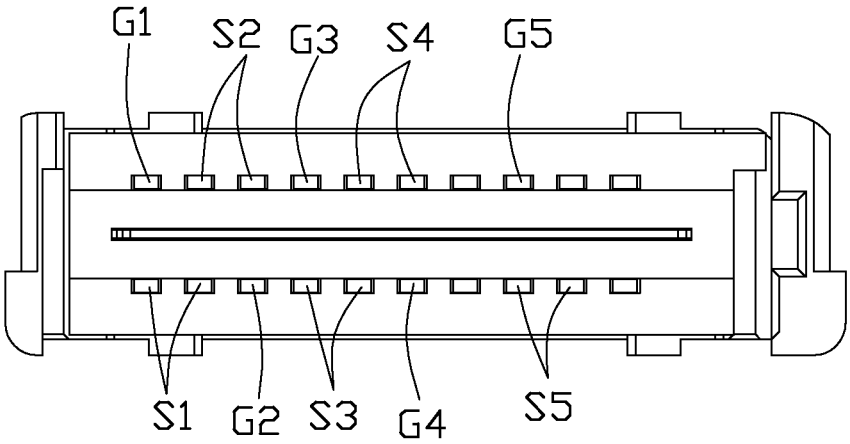
FIG. 10 is a back view of the terminals and the insulated housing assembled with each other.

Referring to FIGS. 7-9, a plurality of terminals 3 are divided into five groups S1,G1; S2,G2; S3,G3; S4,G4; S5,G5. Each group has a differential pair of signal terminals S1~S5 and a grounding terminal G1~G5. The pair of differential signal terminals S1~S5 are located in different rows, and the grounding terminals G1~G5 are also located in different rows. The mating portions 32 of the pair of differential signal terminals S1~S5 are located on a same level. Two mating portions 32 of a differential pair of signal terminals S1~S5 and a mating portion 32 of a grounding terminal G1~G5 are arranged into isosceles triangular configuration in a vertical plane. A terminating portion 33 of a grounding terminal G1~G5 and two terminating portions 33 of a differential pair of signal terminals S1~S5 are arranged into right-angled triangular configuration in a vertical plane.

Referring to FIGS. 4-5, the spacer 4 comprises a base portion 41, a tongue portion 42 extending forwardly from a front surface of the base portion 41, and a rear portion 43 extending rearward from a rear surface of the base portion 41. The tongue portion 42 defines a plurality of ribs 420 respectively formed on a top and bottom surfaces thereof. The base portion 41 defines a plurality of channels 410 throughout the front and the rear face thereof. The rear portion 43 of the spacer 4 defines a receiving slot 430 recessed from a rear surface thereof.

Referring to FIGS. 5-6, the cable assembly 100 further comprises a metallic plate 5 received into the receiving slot 430 in the rear portion 43 of the spacer 4 and located between the upper an lower terminal rows.

Referring to FIGS. 1-3, the cover 6 comprises an upper cover 61 and a lower cover 62 assembled with the upper cover 61. The upper cover 61 and the lower cover 62 respectively defines a mounting hole 610,620 and a mounting posts 611, 621 cooperated with corresponding mounting holes 610,620. The upper cover 61 and the lower cover 62 are respectively defines a positioning post 612,622 and a positioning groove 613,623 respectively cooperated with the positioning post 612,622. The upper cover 61 also defines a button 614 used to control locking arm 130 moved along a vertical direction.

Referring to FIGS. 1-3, the cable 7 comprise a number of wires (not shown) separated into an upper row and a lower row. The wires also have same arrangement as that of the terminals 3.

Referring to FIGS. 1-10, the assembling process of the cable assembly 100 made in according to the present invention comprises following steps. Firstly, the terminals 3 are arranged on the spacer 4. The body portions 31 of the terminals 3 are supported by the rib 420 of the tongue portion 42. The mating portions 33 are located beyond a front surface of the tongue portion 42. The terminating portions 33 are passed through the channels 410 and extended to upper and lower surfaces of the rear portion 43. Secondly, the metallic plate 5 is assembled into the receiving slot 430 of the spacer 4. Thirdly, the terminals 3 and the spacer 4 are together assembled to the insulated housing 2 until the base portions 41 abuts against rear surface of the insulated housing 2. The mating portions 32 of the terminals 3 are received in the terminal passages 25 of the insulated housing 2. The tongue portion 42 of the spacer 4 is received in the receiving space 20. And the protruding portions 210 of the insulated housing 2 are received in the cutouts 411 of the base portions 41 of the spacer 4.

Fourthly, the wires of the cable 7 are respectively soldered to the terminating portions 33 of the terminals 3. Fifthly, the insulated housing 2 is enclosed by the front frame portion 11 of the first shield portion 1*a* of the metallic shell 1. Thus, the pair of locking members 211 of the two protruding potions 210 of the insulated housing 2 are inserted into the pair of apertures 1131 of the rear section of the top side 113 of the frame portion 11. Simultaneously, the base portion 43 of the spacer 4 and the exposed wires are received into the rear U-shaped portion 12 of the metallic shell 1. Then second shield portion 1*b* is assembled to the first shield portion 1*a*. Thus, the tabs 133 of the top section 131 are passed through corresponding holes 1110 of the top side 111. The locking tabs 134 of the side section 132 of the second shield portion 1*b* are engaged with the locking holes 123 of the side section 121 of the first shield portion 1*a*. Sixthly, the cover 6 is assembled to the metallic shell 1.

After the above assembling steps, the entire process of assembling of the cable assembly 100 is finished. As the terminating sections 33 of the upper rows of terminals 3 are respectively in alignment with the terminating sections 33 of the lower rows of terminals 3 along a vertical direction, so a width between two terminating sections 33 of two lateral terminals 3 is short and narrow. Thus, the solder between the terminating section 33 and the wire will not short-circuit contact with inner side of metallic shell 1. And, more receiving space is formed in the cable assembly 100 for inner mold surrounding the terminating sections 33 of the terminals 3 entered therein.

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

What is claimed is:

1. A cable assembly comprising:

a housing defining a receiving space;

a metallic shell surrounding the housing;

a plurality of terminals arranged into two rows and received in the housing, each terminal defining a front mating portion and a rear terminating portion; and a cable electrically connected with the plurality of terminals;

wherein the plurality of terminals are divided into several terminal groups, each terminal group comprises a pair of signal terminals and a grounding terminal located on different rows, and the two terminating portions of the pair of signal terminals and the terminating portion of the grounding terminal of same terminal group are arranged into right-angled triangular configuration in a vertical plane;

a spacer assembled to a rear end of the housing and having a tongue portion received into the receiving space, and a metallic plate disposed in the spacer and between the two rows of terminals;

a cover surrounding a rear end of the metallic shell;

wherein the spacer defines a base portion and a forward tongue portion;

wherein the base portion of the spacer defines two rows of channels through front and rear faces thereof for the terminating portions of the terminals to pass through, and the tongue portion of the spacer defines a plurality of ribs for supporting the body portions of the terminals.

2. The cable assembly as claimed in claim 1, wherein the mating portions of the differential signal terminal and the mating portions of the grounding terminal are arranged into an isosceles triangular configuration in a vertical plane.

3. The cable assembly as claimed in claim 1, wherein the metallic shell comprises a first shield part and second shield part assembled with each other, the housing has two slits on a top surface thereof, and the second shield part defines a pair of locking arms extending into the two slits.

4. The cable assembly as claimed in claim 1, wherein each terminal comprises a body portion connecting with the terminating portion and the mating portion, and the terminating portion and the body portion are on the same level.

5. The cable assembly as claimed in claim 4, wherein the terminating portion of each terminal is offset from the mating portion and the body portion.

6. A cable assembly comprising:

an insulated housing defining a plurality of terminal passages and a receiving space communicated with the plurality of terminal passages;

a plurality of terminals received into the plurality of terminal passages and arranged into two rows, each terminal defining a front mating portion and a rear terminating portion, each row of terminals comprising a pair of signal terminals and a grounding terminal;

a cable electrically connected with the plurality of terminals;

a metallic shell surrounding the housing; and a cover surrounding a rear portion of the metallic shell;

wherein the terminating portions of one row of terminals are respectively in alignment with the terminating portions of the other row of terminals, and the two terminating portions of the two signal terminals of one row of terminals and the terminating portion of the grounding terminal of the other row of terminals are arranged into right-angled triangular configuration in a vertical plane;

wherein the cable assembly further comprises a spacer received into the receiving space of the insulated housing along a rear-to-front direction;

wherein a metallic plated is formed in the spacer and located between two rows of terminals.

7. The cable assembly as claimed in claim 6, wherein two mating portions of two signal terminals of one row of terminals and a mating portion of a grounding terminal of the another row of terminals are arranged into isosceles triangular configuration in a vertical plane.

8. The cable assembly as claimed in claim 7, wherein the terminating portion of each terminal is not in alignment with the mating portion of each terminal along a front to rear direction.

9. The cable assembly as claimed in claim 7, wherein the metallic shell defines a pair of locking arms, the cover defines a button being capable of actuating the pair of locking arms.

10. A cable connector assembly comprising: an insulative housing unit; and two rows of terminals disposed in the housing each along a row direction, each row of said terminals defining differential pairs and grounding contacts alternately arranged with each other along said row direction, each of said terminals defining a front mating portion and a rear terminating portion in a front-to-back direction perpendicular to said row direction; wherein each differential pair of each row and a corresponding neighboring grounding contact of the other row are arranged with an isosceles triangular configuration around the front mating portions while with an asymmetrical triangular configuration around the terminating portions due to an offset structure between the front mating portion and a rear terminating portion of each terminal in the row direction;

wherein a shielding plate is located between two rows of the terminals only around the terminating potions.

11. The cable connector assembly as claimed in claim 10, wherein the offset structures in said two rows are directed opposite to each other in said row direction.

12. The cable connector assembly as claimed in claim 10, wherein the front mating portions in one row of terminals and those in the other row of terminals are staggered arranged with each other along the row direction while the rear terminating portions in one row of terminals and those in the other row are aligned with each other in said front-to-back direction.

13. The cable connector assembly as claimed in claim 10, wherein said offset structure extends not only in the row direction but also in a vertical direction perpendicular to said row direction and said front-to-back direction.

* * * * *